US007201002B1

(12) United States Patent
Brown

(10) Patent No.: US 7,201,002 B1
(45) Date of Patent: Apr. 10, 2007

(54) ANTI-WEATHERING APPARATUS METHOD FOR LIQUID AND VAPOR STORAGE SYSTEMS

(75) Inventor: Ross M. Brown, Murrieta, CA (US)

(73) Assignee: Cryogenic Group, Inc., Murrieta, CA (US)

( * ) Notice: Subject to any disclaimer, the term of this patent is extended or adjusted under 35 U.S.C. 154(b) by 414 days.

(21) Appl. No.: 10/418,915

(22) Filed: Apr. 21, 2003

(51) Int. Cl.
*F17C 5/02* (2006.01)
*F17C 7/04* (2006.01)

(52) U.S. Cl. ..... 62/47.1; 62/48.1; 62/50.2

(58) Field of Classification Search ..... 62/47.1, 62/48.1, 614, 7, 54.1, 50.2, 50.4, 50.7
See application file for complete search history.

(56) References Cited

U.S. PATENT DOCUMENTS 3,260,060 A * 7/1966 Paulinkonis et al. ..... 62/47.1
3,304,739 A * 2/1967 Erath ..... 62/244
5,373,700 A * 12/1994 McIntosh ..... 62/48.1
5,467,603 A * 11/1995 Lehman et al. ..... 62/50.2

* cited by examiner

*Primary Examiner*—Denise L. Esquivel
*Assistant Examiner*—Richard L. Leung
(74) *Attorney, Agent, or Firm*—William W. Haefliger

(57) ABSTRACT

In combination, pressurized fluid contained in a storage vessel, in both liquid and vapor regions, a heat exchanger in the vapor region of the vessel, and a first pressure regulator having an inlet side in communication with liquid in the vessel, and having an outlet side in communication with the heat exchanger, whereby if pressure in the vessel rises to the setting of the regulator, it opens and admits liquid from the vessel to the heat exchanger, to vaporize in that exchanger causing vapor in the vessel to condense, and reducing pressure in the vessel.

8 Claims, 1 Drawing Sheet

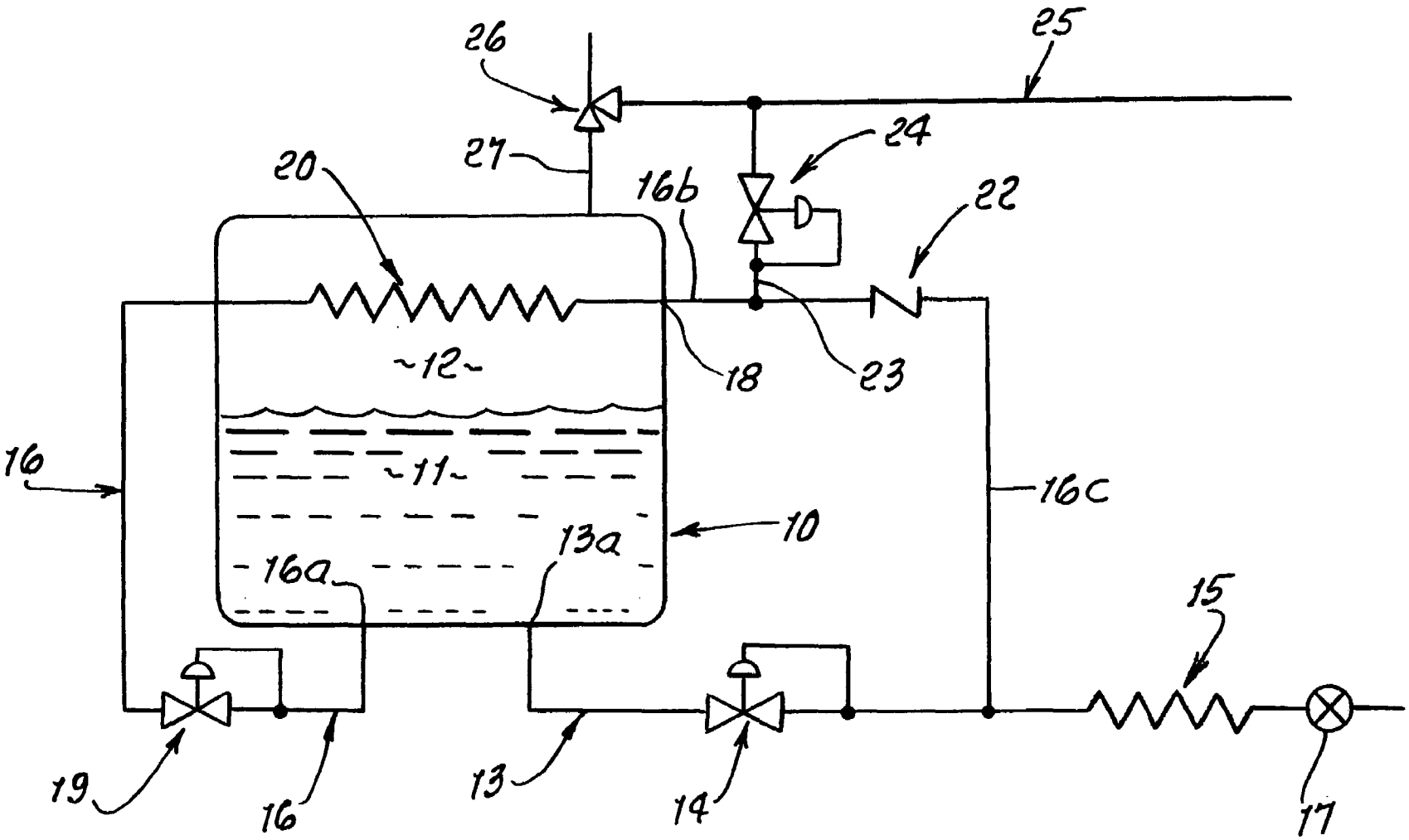
25
24
22
23
16b
18
16c
10
15
17
26
27
20
12
11
13a
16a
13
14
16
19
16

ANTI-WEATHERING APPARATUS METHOD FOR LIQUID AND VAPOR STORAGE SYSTEMS

BACKGROUND OF THE INVENTION

This invention relates generally to anti-weathering of storage systems for volatile multi-component fluid mixture which tend to "weather" in storage. More specifically, it concerns improvements in anti-weathering storage system for liquified material gas, referred to herein as LNG.

Weathering refers to the enrichment of the liquid state with the components with higher temperature boiling points and enrichment of the vapor state with the components with lower temperature boiling points. In the case of LNG the fluids with the higher boiling point temperatures include Propane, Butane, Ethane, and Ethylene. The primary lower boiling point fluid is Methane. Then as vapor venting occurs in a normal storage system to "boil off" the remaining liquid becomes increasingly "rich" in the components with the higher temperature boiling point, sometimes referred to as "heavies". Typical LNG compositions range from 80 to 95 percent Methane.

In the case of LNG storage for engine fuel and other applications where it is desirable, and often necessary, to maintain a nearly constant BTU value, or Cetane value for engines, it is a problem to have varying liquid compositions because the BTU and Cetane values also vary which can damage the engine and/or degrade engine performance or cause erratic or dangerous conditions in other fuel burning appliances.

There is need for improvements in anti-weathering systems which obviate the above difficulties and problems.

SUMMARY OF THE INVENTION

It is a major object of the invention to provide a system and method that eliminate weathering of LNG, or other multi-component fluids, through elimination of vapor venting.

It is another object of the invention to provide, in combination:

a) pressurized fluid contained in a storage vessel, in both liquid and vapor regions, b) a first heat exchanger in the vapor region of the vessel, c) and a first pressure regulator having an inlet side in communication with liquid in the vessel, and having an outlet side in communication with the heat exchanger, whereby if pressure in the vessel rises to the setting of the regulator, it opens and admits liquid from the vessel to the heat exchanger, to vaporize in that exchanger causing vapor in the vessel to condense, and reducing pressure in the vessel.

As referred to, the liquid in the vessel may preferably be LNG, and the vapor in the vessel may be vaporized LNG.

An additional object is to provide a second pressure regulator having an inlet side in communication with liquid in the vessel, and a discharge side in series communication with a second heat exchanger, whereby user required flow of liquid passes through the second pressure regulator and second heat exchanger.

Yet another object includes provision of a pressure relief regulator having an inlet side in communication with vapor in the first heat exchanger, whereby vapor generated in the first heat exchanger flows through the pressure relief regulator, as for example in the event of absence of user required flow of liquid such as LNG in the vessel.

These and other objects and advantages of the invention, as well as the details of an illustrative embodiment, will be more fully understood from the following specification and drawings, in which:

DRAWING DESCRIPTION

FIG. 1 is a system diagram.

DETAILED DESCRIPTION

Referring to FIG. 1, liquid (as for example LNG) is contained in a storage vessel 10, as indicated at 11 and vapor (such as LNG vapor for example) is shown at 12. Pressurized liquid is delivered to the user via pipe 13, having an inlet 13*a* in communication with 11, a pressure regulator 14 in series with 13, a heat exchanger 15 operating to convert liquid to gas, and a delivery point represented by a flow control valve 17. If the user desires liquid at point 17, heat exchanger 15 is eliminated. Regulator 14 may be set at $\rho_1$ (which may be 15 p.s.i.g. for example, in the case of LNG).

A duct 16 has an extension at 16*a* to receive pressurized liquid from region 11 in the vessel 10. Duct 16 extends to the interior of the vessel in the vapor region 12, and exits the vessel at 18. A second pressure regulator 19 is connected in series with duct 16, outside the vessel; and a heat exchanger 20 is connected in series with duct 16, within vapor region 12. In operation, if pressure in the vessel rises to the setting $\rho_2$ of regulator 19 (20 psig for example in the case of LNG), it opens and admits flow of liquid to the heat exchanger 20. Due to a pressure difference between liquid vaporizing in the coil of 20, and the pressure of vapor at region 12 in the vessel, a temperature difference is created, and vessel vapor 12 is condensed, reducing the pressure in the vessel.

If liquid flow to the user at 17 is occurring, the vapor vaporized in the heat exchanger 20 flows through duct extension 16*a* to and through a check valve 22, and through duct extension 16*c* to duct 13 and to the user at 17. If there is no user requirement, i.e. valve 17 is closed, then vapor generated in the heat exchanger 20, and exiting the vessel via duct extension 16*b*, flows via side duct 23 to and through a pressure relief regulator 24, set at $\rho_3$ (25 psig for example, for LNG) and to vent 25. Thus, $\rho_3>\rho_2>\rho_1$. A pressure relief valve, or valves, indicated at 26, have direct connection via duct 27 with vapor region 12.

In all cases, there is a temperature difference created between liquid vaporizing in heat exchanger 20 and the vapor 12 in the storage vessel. In no event, except in an emergency, does the vessel vapor vent at 26 and allow "weathering" of the liquid 11 in the storage vessel.

I claim:

1. In combination a) pressurized fluid contained in a storage vessel, in both liquid and vapor regions, b) a first heat exchanger in the vapor region of the vessel, c) and a first pressure regulator having an inlet side in communication with liquid in the vessel, and having an outlet side in communication with the first heat exchanger, whereby if pressure in the vessel rises to the setting of the regulator, it opens and admits liquid from the vessel to the heat exchanger, to vaporize in that exchanger causing vapor in the vessel to condense, and reducing pressure in the vessel, d) a second pressure regulator having an inlet side in communication with liquid in the vessel, and a discharge side in series communication with a second heat exchanger, whereby user required flow of liquid passes through the second pressure regulator and second heat exchanger, e) and a third pressure regulator having an inlet side in communication with vapor in the first heat exchanger, and also in communication via a check valve with the inlet side of the second heat exchanger, and with the outlet side of the second pressure regulator, whereby vapor generated in the first heat exchanger flows to the user in by-passing relation to the second pressure regulator, and flows through the third pressure regulator, as for example in the event of absence of user required flow from the vessel, there being no direct interconnection of the first and second regulators outside the vessel, f) and wherein said liquid is LNG and said vapor is vaporized LNG.

2. The combination of claim 1 wherein said third pressure regulator is a pressure relief regulator.

3. The combination of claim 1 wherein said first pressure regulator is set at a pressure $\rho_1$, and said second pressure regulator is set at a pressure $\rho_2$, where $\rho_1>\rho_2$.

4. The combination of claim 1 wherein:

i) said first pressure regulator is set at a pressure $\rho_1$, ii) said second pressure regulator is set at a pressure $\rho_2$, iii) said third pressure regulator is set at a pressure $\rho_3$, and wherein:

$\rho_3>\rho_1>\rho_2$.

5. The combination of claim 4 wherein said three regulators are outside the vessel.

6. In combination a) pressurized fluid contained in a storage vessel, in both liquid and vapor regions, b) a first heat exchanger in the vapor region of the vessel, c) and a first pressure regulator having an inlet side in communication with liquid in the vessel, and having an outlet side in communication with the first heat exchanger, whereby if pressure in the vessel rises to the setting of the regulator, it opens and admits liquid from the vessel to the heat exchanger, to vaporize in that exchanger causing vapor in the vessel to condense, and reducing pressure in the vessel, d) a second pressure regulator having an inlet side in communication with liquid in the vessel, and a discharge side in series communication with a second heat exchanger, whereby user required flow of liquid passes through the second pressure regulator and second heat exchanger, e) and a third pressure regulator having an inlet side in communication with vapor in the first heat exchanger, and also in communication via a check valve with the inlet side of the second heat exchanger, and with the outlet side of the second pressure regulator, whereby vapor generated in the first heat exchanger flows to the user in by-passing relation to the second pressure regulator, and flows through the third pressure regulator, as for example in the event of absence of user required flow from the vessel, there being no direct interconnection of the first and second regulators outside the vessel, f) and including said check valve in a line communicating between the inlet side of the third pressure regulator and said second heat exchanger.

7. The combination of claim 6 wherein said liquid is LNG, and said vapor is vaporized LNG.

8. The method of regulating pressure in a storage vessel for pressurized fluid existing in both liquid and vapor regions, that includes a) providing a first heat exchanger in contact with vapor in or from said vapor region, b) providing a first pressure regulator having an inlet side in communication with liquid in or from said liquid region, and an outlet side in communication with the heat exchanger, c) whereby if pressure in the vessel rises to the setting of the regulator, it opens and admits liquid from the vessel to the heat exchanger, to vaporize in that exchanger causing vapor in the vessel to condense, and reducing pressure in the vessel, d) providing a second pressure regulator having an inlet side in communication with liquid in the vessel, and a discharge side in series communication with a second heat exchanger, whereby user required flow of liquid passes through the second pressure regulator and second heat exchanger, and providing a third pressure regulator having an inlet side in communication with vapor in the first heat exchanger, and also in communication via a check valve with the inlet side of the second heat exchanger and with the outlet side of the second pressure regulator whereby vapor generated in the first heat exchanger flows to the user in by-passing relation to the second pressure regulator, and flows through the third pressure regulator, as for example in the event of absence of user required flow of from the vessel, there being no direct interconnection of the first and second regulators outside the vessel, e) and wherein said liquid is LNG and said vapor is vaporized LNG.

* * * * *

UNITED STATES PATENT AND TRADEMARK OFFICE

CERTIFICATE OF CORRECTION

PATENT NO. : 7,201,002 B1
APPLICATION NO. : 10/418915
DATED : April 10, 2007
INVENTOR(S) : Ross M. Brown It is certified that error appears in the above-identified patent and that said Letters Patent is hereby corrected as shown below:

Column 3, line 22; "regulator is set at a pressure where $p_2$, where $p_1>p_2$" should read --regulator is set at a pressure $p_2$, where $p_2>p_1$.--

Column 3, line 28; "$p_3>p_1>p_2$." should read --$p_3>p_2>p_1$.--

Signed and Sealed this

Twenty-sixth Day of January, 2010

David J. Kappos

David J. Kappos
*Director of the United States Patent and Trademark Office*